US005370311A

United States Patent [19]

Chen

[11] Patent Number: 5,370,311

[45] Date of Patent: Dec. 6, 1994

[54] SPRINKLER

[76] Inventor: Hung-Ming Chen, No. 18, Lane 1100, Sec. 1, Li Ming Rd., Taichung City, Taiwan, Prov. of China

[21] Appl. No.: 225,575

[22] Filed: Apr. 11, 1994

[51] Int. Cl.[5] ..... B05B 3/04

[52] U.S. Cl. ..... 239/233; 239/230; 239/511; 239/DIG. 1

[58] Field of Search ..... 239/230, 231, 232, 233, 239/DIG. 1, 503, 509, 510, 511, 518, 522

[56] References Cited

U.S. PATENT DOCUMENTS

| | | | |
|---|---|---|---|
| 2,596,383 | 5/1952 | Dunham | 239/231 |
| 2,989,248 | 6/1961 | Norland | 239/233 |
| 2,992,780 | 7/1961 | Norland | 239/233 |
| 3,779,462 | 12/1973 | Bruninga | 239/DIG. 1 |
| 3,871,582 | 3/1975 | Biddle | 239/233 |
| 4,858,829 | 8/1989 | Drechsel | 239/233 |
| 5,031,835 | 7/1991 | Rojas | 239/233 |

FOREIGN PATENT DOCUMENTS

| | | | |
|---|---|---|---|
| 1658914 | 6/1991 | U.S.S.R. | 239/DIG. 1 |

*Primary Examiner*—Kevin P. Shaver
*Assistant Examiner*—Christopher G. Trainor
*Attorney, Agent, or Firm*—William E. Pelton

[57] ABSTRACT

A sprinkler includes a main body, a head part, a bracket and a swinging arm. The head part has two outlets disposed therein and the bracket has an extending strip disposed thereon and is disposed above an upper end of the head part. The extending strip has a first distributing plate with a rough surface formed thereon and which is rotatabiy engaged thereto. The swinging arm is pivotally engaged between the head part and the bracket via a spring disposed between the bracket and the swinging arm, and extends transversely through the bracket. A second distributing plate, having a rough surface formed thereon, is engaged to an end of the swinging arm, such that water ejected from one of the outlets will impact on the first distributing plate after impacting the second distributing plate.

4 Claims, 5 Drawing Sheets

SPRINKLER

BACKGROUND OF THE INVENTION

The present invention relates to a sprinkler and, more particularly, to a sprinkler with an improved structure, and which sprays water not only to a broad area far from the sprinkler but also to a region near the sprinkler.

A conventional sprinkler usually has an ability of ejecting water to a long distance, however, the water is sent in a form of larger drops which may cause a damage to the plants, in addition, the plants planted in a region near the sprinkler always lack water.

The present invention intends to provide an improved sprinkler to mitigate and/or obviate the abovementioned problems.

SUMMARY OF THE INVENTION

The present invention provides a sprinkler which includes a main body, a head part, a bracket and a swinging arm. The head part has two outlets disposed therein and the bracket has an extending strip disposed thereon and is disposed above an upper end of the head part. The extending strip has a first distributing plate with a rough surface formed thereon and which is rotatably engaged thereto. The swinging arm is pivotally engaged between the head part and the bracket via a spring disposed between the bracket and the swinging arm, and extends transversely through the bracket. A second distributing board, having a rough surface formed thereon, is engaged to an end of the swinging arm, such that water ejected from one of the outlets will impact on the first distributing plate after impacting on second distributing board.

It is an object of the present invention to provide a sprinkler which has a feature of producing a better moisturizing spray.

It is still another object of the present invention to provide a sprinkler which has an outlet producing a spray near the main body.

Other objects, advantages, and novel features of the invention will become more apparent from the following detailed description when taken in conjunction with the accompanying drawings.

DETAILED DESCRIPTION OF THE PREFERRED EMBODIMENT

Figure 1:
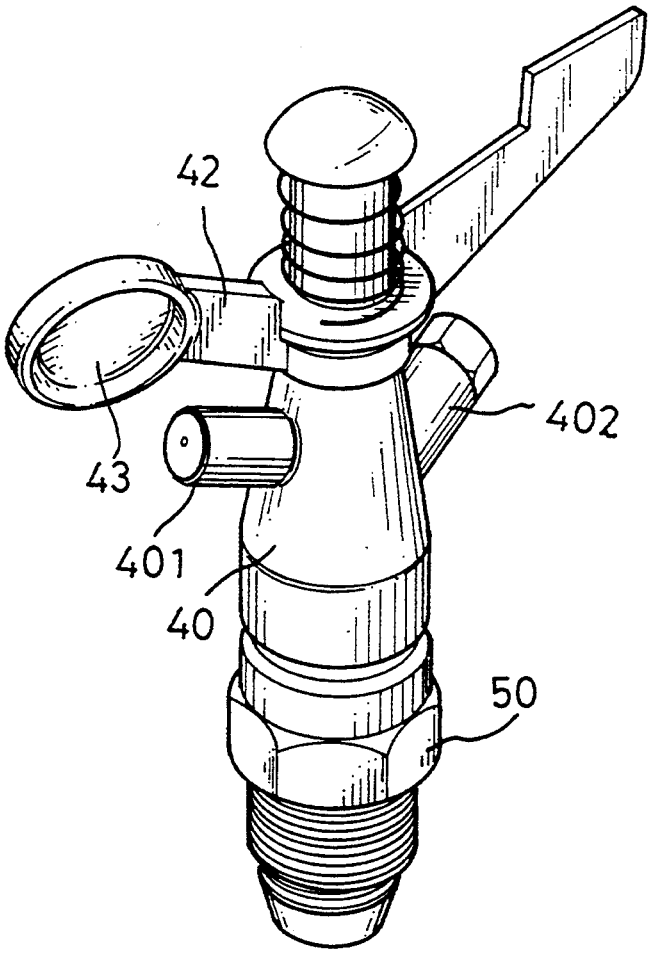
FIG. 1 PRIOR ART
FIG. 1 is a perspective view of a conventional sprinkler.

For a better understanding of a conventional sprinkler, please refer to FIG. 1. Most sprinklers in current use have emphasized their ability of sending water to a great distance. In FIG. 1, for example, a sprinkler is composed of a head part 40, a swinging arm 42 and a main body 50. The head part 40 is mounted on the main body 50 and two outlets 401, 402 are formed thereon, the swinging arm 42 having first end with a inclined plate 43 disposed thereon, and a second end is pivotally engaged to the head part 40 and is located above the two outlets 401, 402, and the swinging arm 42 is further engaged to one end of a spring 44 whose the other end is engaged to the head part 40. Water ejected from the outlet 401 impacts on the inclined plate 43 of the swinging arm 42 in order to change a direction of water and therefore produces drops to spray to a broader region. The swinging arm 42 is rotated partially by the water exerting a force on the inclined plate 43, and then the swinging arm 42 is biased back by the spring 44. However, the water ejected from the sprinkler seldom falls on a region near the sprinkler, further, some plants do not need a lot of water, and some others perhaps cannot bear larger water drops to hit them directly.

Figure 2:
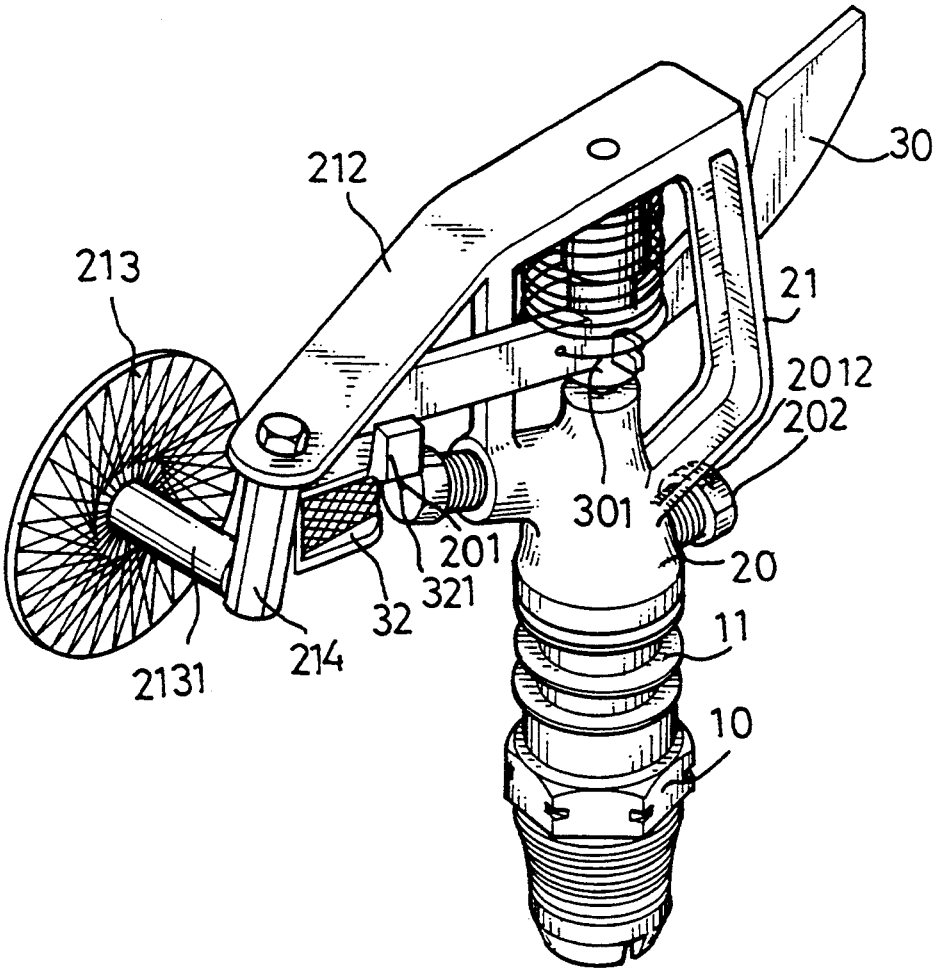
FIG. 2 is a perspective view of a sprinkler in accordance with the present invention.
Figure 3:
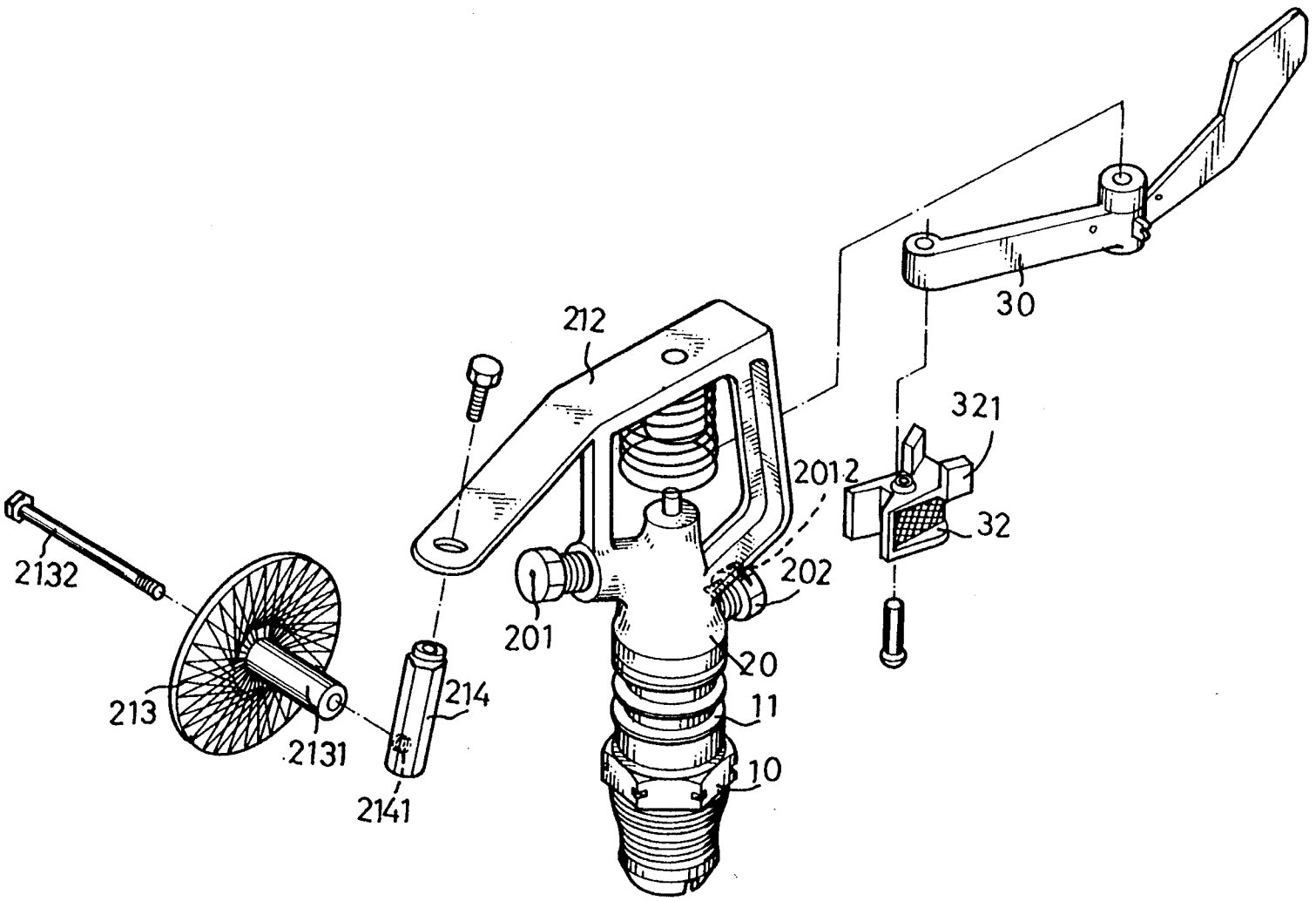
FIG. 3 is a exploded view of the sprinkler in accordance with the present invention.
Figure 4:
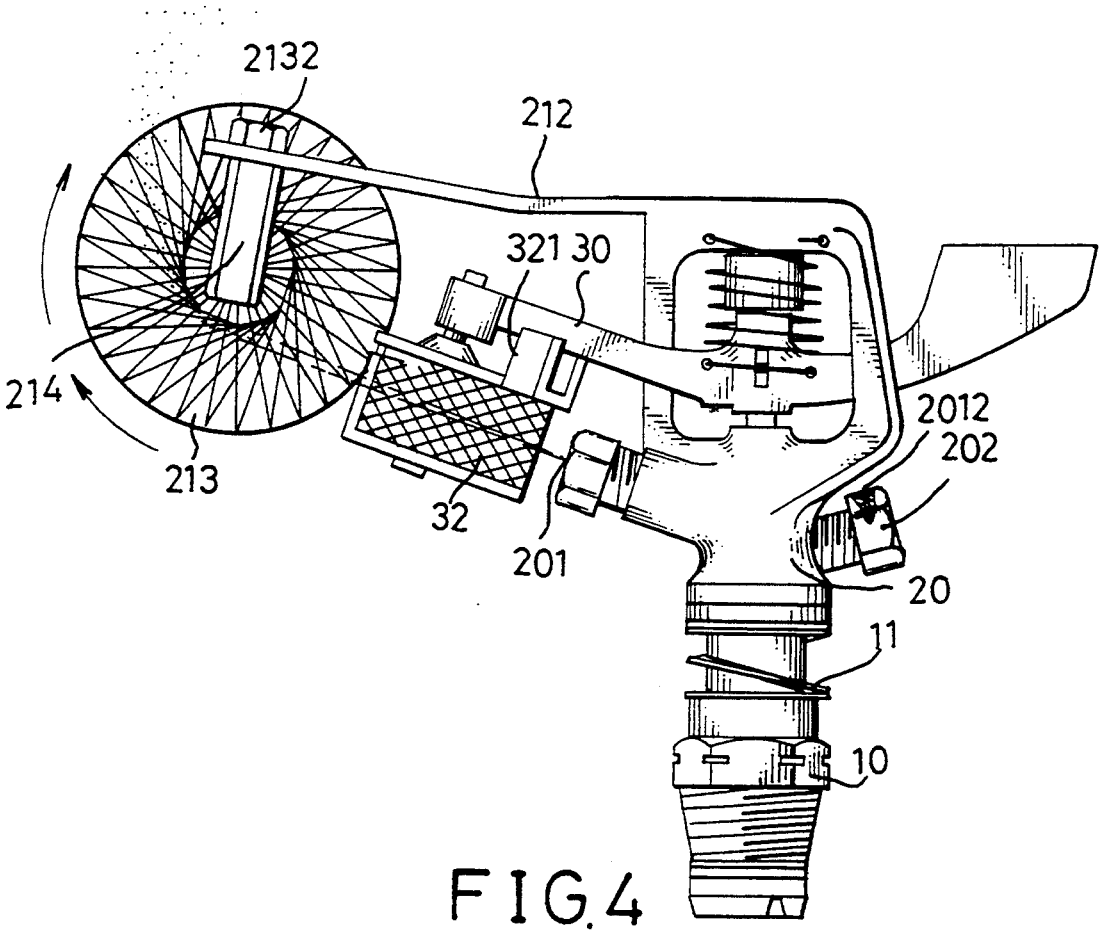
FIG. 4 is a side elevational view of the sprinkler in accordance with the present invention.

Referring now to FIGS. 2 through 4, a sprinkler in accordance with the present invention generally includes a main body 10, a head part 20, a bracket 21 and a swinging arm 30. The main body 10 has a first end connecting to a housing (not shown), and a second end engaging the head part 20 via a spring 11 disposed therebetween. The head part 20 has first and second outlets 201, 202 disposed therein and the bracket 21 with strip 212 extending therefrom is disposed above an upper end of the head part 20. The second outlet 202 communicates to a slot 2012 defined in the head part 20. The extending strip 212 has a substantially vertical bar 214 which is securely engaged to a distal end of the extending strip 212 by threading a bolt therethrough. A threaded recess 2141 is defined in a side of the vertical bar 214. A first distributing plate 213 has a rough surface formed thereon and further has a connecting socket 2131 disposed to a center of the rough surface. The first distributing plate 213 is rotatably engaged to the vertical bar 24 by inserting a bolt 2132 through the plate 213 and the socket 2131, and threading in the threaded recess 2141 of the vertical bar 214.

The swinging arm 30 has a hole defined in a middle portion thereof for mounting between a boss projecting from an upper end of the head part 20 and a stud projecting from an under side of the bracket 21, thereby the swinging arm 30 is pivotally engaged therebetween via a spring 301 disposed between the swinging arm 30 and the bracket 21, and which extends transversely through the bracket. A second distributing plate 32 having a rough surface formed thereon is pivotally engaged to an end of said swinging arm 30, the second distributing plate 14 having two vertically spaced lugs 321 which extend to both sides of the swinging arm 30.

Figure 5:
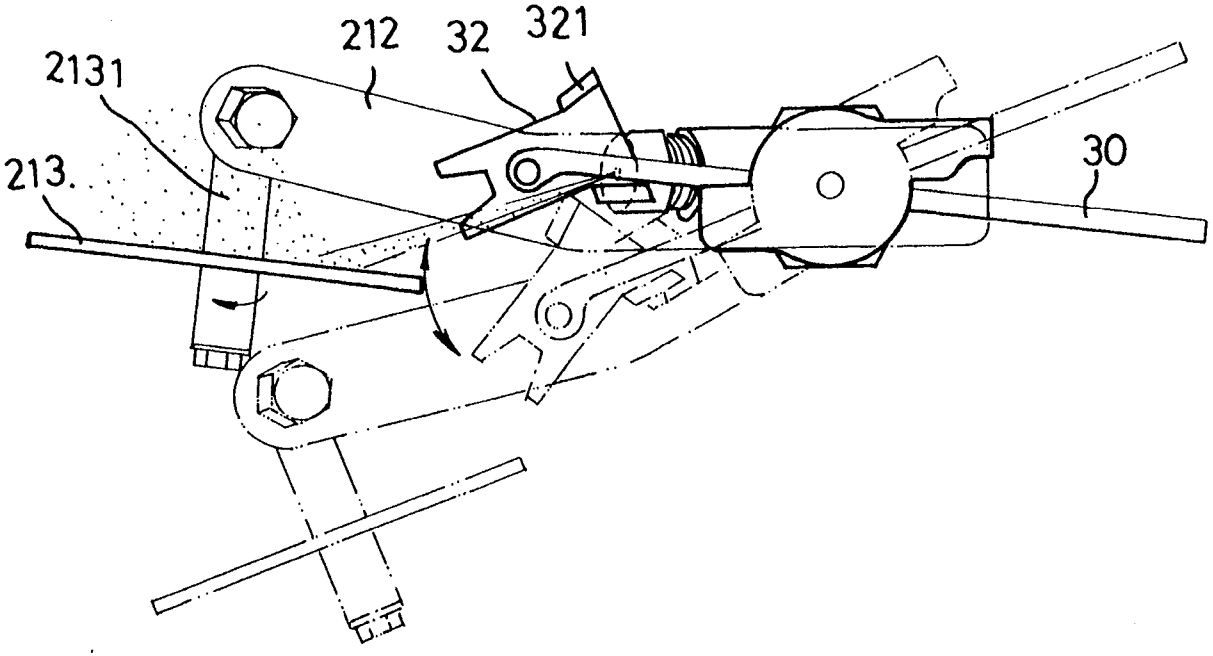
FIG. 5 is a top elevational view of the sprinkler showing a position in phantom line of an extending strip and a swinging arm in accordance with the present invention to move thereto.

Referring to FIG. 5, the water ejected from the first outlet 201 will impact on the pivoted second distributing plate 32 and thus the swinging arm 30 is rotated partially by the lugs 321 pushing thereto, and the swinging arm 30 will be biased back by an action of the spring 301. And then, the water will impact on the first distributing plate 213 via the second distributing plate 32, and thereby exert a force to the bracket 21 associated with the action of the swinging arm 30 to rotate the head part 20 partially and which will be biased back by an action of the spring 11. Therefore, the head part 20 and the swinging arm 30 will proceed a reciprocating movement at a limited range. The water impacts on the first distributing plate 213 and sprays out in a form of moisture owing to the impact of the rough surface formed thereon. On the other hand, water ejected from the second outlet 202 forms a fan-shaped spray through the slot 2012 and falls down to the region near the main body 10.

Therefore, the sprinkler in accordance with the present invention can produce not only distant and moisturizing spray but also can produce a fan-shaped spray to a near region, and this provides an improvement on conventional sprinklers.

Although the invention has been explained in relation to its preferred embodiment, it is to be understood that many other possible modifications and variations can be made without departing from the spirit and scope of the invention as hereinafter claimed.

I claim:

1. A sprinkler comprising:

a main body having a first end connecting to a housing, and a second end engaging to a head part via a spring disposed therebetween, said head part having first and second outlets disposed therein and a bracket with an extending strip disposed thereon being disposed above an upper end of said head part, said extending strip having a first distributing plate rotatably engaged thereto and a rough surface formed thereon;

a swinging arm being pivotally engaged between said head part and said bracket and a spring being disposed between said bracket and said swinging arm, and extending transversely through said bracket, a second distributing plate, having a rough surface formed thereon, being engaged to an end of said swinging arm, such that water will impact on said first distributing plate after impacting said second distributing plate.

2. The sprinkler as claimed in claim 1 wherein said extending strip engages with a vertical bar at a distal end thereof and said first distributing plate is rotatably engaged to said vertical bar.

3. The sprinkler as claimed in claim 1 wherein said second distributing plate is located at a position corresponding to said first outlet to be impacted by water ejected therefrom.

4. The sprinkler as claimed in claim 1 wherein said first outlet communicates with a slot in order to provide a broader spray however near said main body.

* * * * *